United States Patent [19]

Powell

[11] 4,305,033

[45] Dec. 8, 1981

[54] POLYPHASE FERRORESONANT VOLTAGE STABILIZER HAVING INPUT CHOKES WITH NON-LINEAR IMPEDANCE CHARACTERISTIC

[75] Inventor: Jeffrey M. Powell, Columbus, Ohio

[73] Assignee: Liebert Corporation, Columbus, Ohio

[21] Appl. No.: 120,525

[22] Filed: Feb. 11, 1980

[51] Int. Cl.[3] ..... G05F 3/06

[52] U.S. Cl. ..... 323/306; 323/308

[58] Field of Search ..... 363/39, 40, 75; 323/60, 323/61, 306-309

[56] References Cited

U.S. PATENT DOCUMENTS

| | | | |
|---|---|---|---|
| 3,341,766 | 9/1967 | Rhyne . | |
| 3,351,849 | 11/1967 | Mesenhimer | 323/45 |
| 3,390,320 | 6/1968 | Kammiller et al. . | |
| 3,390,321 | 6/1968 | Plow . | |
| 3,450,981 | 6/1969 | Fletcher et al. | 323/60 |
| 3,500,166 | 3/1970 | Mesenhimer et al. . | |
| 3,544,885 | 1/1970 | Friedlander et al. | 323/61 |
| 3,803,479 | 4/1974 | Rathor | 323/60 |
| 3,836,854 | 9/1974 | Wehman . | |

OTHER PUBLICATIONS

Practical Equivalent Circuits for Electromagnetic Devices by Biega, The Electronic Engineer, Jun. 1967.

Static-Magnetic Regulators—A Cure for Power Line "Spikes", by Kimball, Electronic Products, reprinted by Thomas et al., Bulletin No. L-552.

IEEE Transactions on Magnetics, vol. MAG-7, No. 3, pp. 571-574, Sep. 1971.

A Feedback-Controlled Ferroresonant Voltage Regulator Kakalec, IEEE Transactions on Magnetics, vol. MAG-6, No. 1, Mar. 1970.

Design Techniques for Ferroresonant Transformers by Workman, Jr., reprinted by Thomas et al. Inc., Bulletin No. L-551.

Comparison of Inverter Circuits for Use in Fixed Frequency Uninterruptable Power Supplies by Bratton and Powell, Instrument Society of America, ISA-76, International Conference and Exhibit, Oct. 11-14, 1976.

*Primary Examiner*—William H. Beha, Jr.

*Attorney, Agent, or Firm*—Mueller and Smith

[57] ABSTRACT

Power conditioning apparatus particularly suited for computer facilities and including non-linear input chokes connectible with line power. The outputs of the input chokes are serially, magnetically coupled through primary windings to pulse saturable reactors of a synthesizing network which includes a capacitor bank and operates to synthesize a sinewave output. Series tuned traps are coupled to the synthesizer network to avoid the development of harmonics above fundamental.

23 Claims, 15 Drawing Figures

100
94
95
96
92
90
89
88
TX10
TX10
TX10
86
30
54
53
52
58
57
56
TX6
TX5
TX4
TX3
TX2
TX1
50
60
62
64
66
67
68
130
145
132
134
138
136
140
142
144
146
147
150
152
154
156
158
160
162
32
TX6'
TX5'
TX4'
TX3'
TX2'
TX1'
TX9
TX8
TX7
76
75
74
80
79
78
84
83
82
85
40
42
43
44

TURN-ON

LOAD PICK-UP

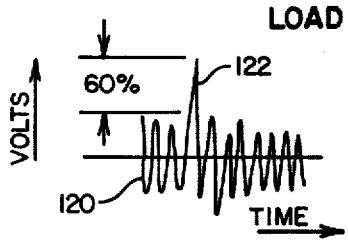
FIG. 9A
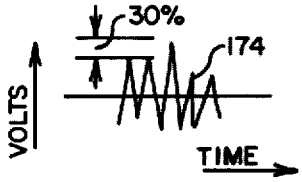
FIG. 9B
FIG. 10
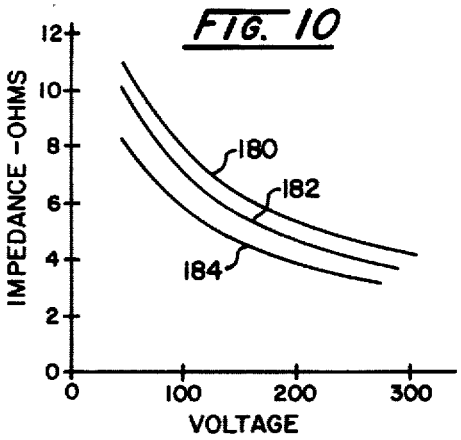
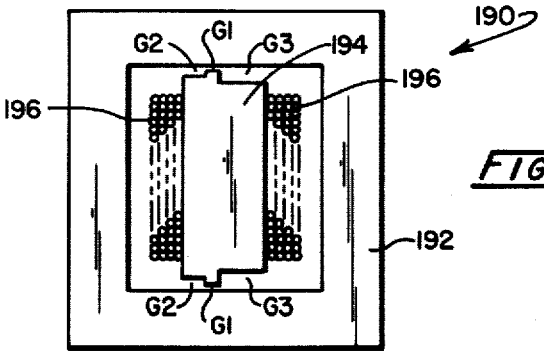
FIG. 11

POLYPHASE FERRORESONANT VOLTAGE STABILIZER HAVING INPUT CHOKES WITH NON-LINEAR IMPEDANCE CHARACTERISTIC

BACKGROUND OF THE INVENTION

Data processing installations require a power supply of very high reliability in terms of waveshape and amplitude. However, line power now available from utility organizations has been observed to be deteriorating in quality to the extent that, in numerous instances, it has become unacceptable for direct application to computer systems. Vagaries in line power stem from many causes but are categorized principally as line noise and out of specification voltage. Line noise may develop from a variety of perturbations, for example spikes may develop due to short circuits along the distribution lines, radio frequency interference, lightning or power factor corrections manifested as oscillatory ringing transients. These transients generally are in a range of 200%-400% of the normal voltage envelope. Under-voltage or over-voltage phenomena generally occur in conjunction with regulator activity and load changing on the power line.

With respect to the effects of these aberrations on computer operations, line noise is characterized by data errors, unprogrammed jumps and software/data file alterations. Momentary under- and over-voltage generally results in automatic computer power down.

A wide variety of techniques for accommodating unreliable power supplies have been available in the marketplace, which generally may be categorized as involving two types of three phase technologies, to wit, systems which recreate a waveform such as motor generators or uninterruptable power supplies (UPS) using a battery charger, batteries, inverter and static switch, and those systems which modify waveforms such as voltage regulators, spike suppressors and the like. The latter systems are basically ineffective in the treatment of all line conditions which may be encountered. Regulators, for example, incorporate feedback loops, the performance of which is too slow to render the devices effective in computer applications. With respect to the former, UPS systems are effective but of such complexity and attendant cost as to render them cost ineffective. Motor generators, simply, are too expensive.

For computer related performance, it is also important to provide an isolation of the power input to the regulator system so as to avoid catastrophic shut-down. Such isolation, of course, aids in the prevention of the passing through of common mode noise. Difficulties have been seen to arise where the regulators have been operated in shunt as opposed to series association with load inputs.

For many years, investigators have found interest in and have utilized constant voltage transformers as a regulating device. In their elementary form, these ferroresonant regulators comprise a non-linear saturable transformer in parallel with a capacitor which is supplied from a source through a linear reactor. The saturable transformer and the capacitor form a ferroresonant circuit wherein the inductive components operate beyond the knee of a conventional magnetization curve. These devices have been seen to hold considerable promise, inasmuch as they are inherently simple, requiring very few components. For example, it is the inherent nature of the ferroresonant transformer to handle all regulating, harmonic neutralizing and current-limiting functions thus permitting the noted simplification. Further, since all regulating and current limiting functions take place inside the ferroresonant transformer, the approach eliminates the need for feedback loops which, as noted above, are found in line voltage regulators. An absence of such loops provides for very reliable and stable current limit and regulation that are inherent to the device and not subject to change or alteration due to component failures. This lack of closed-loop feedback circuits makes the ferroresonant device quite insensitive to non-linear or pulse loads. Because the waveshape is completely recreated, transients and high speed phenomena cannot penetrate the ferroresonant devices.

A wide variety of literature has been generated concerning this approach to regulation, as is evidenced by the following papers:

I. Practical Equivalant Circuits for Electromagnetic Devices by Biega, The Electronic Engineer, June, 1967.

II. Static-Magnetic Regulators—A Cure for Power Line "Spikes" by Kimball, Electronic Products, reprinted by Thomas and Skinner, Inc., Bulletin No. L-552.

III. A New Feedback—Controlled Ferroresonant Regulator Employing a Unique Magnetic Component, Hart, IEEE Transactions on Magnetics, Vol. MAG-7 No. 3, September, 1971, pp 571-574.

IV. A Feedback—Controlled Ferroresonant Voltage Regulator, Kakalec, IEEE Transactions on Magnetics, Vol. Mag-6, No. 1, March, 1970.

V. Design Techniques for Ferroresonant Transformers by Workman, Jr. reprinted by Thomas and Skinner, Inc., Bulletin No. L-551.

VI. Comparison of Inverter Circuits for Use in Fixed Frequency Uninterruptable Power Supplies by Braton and Powell, Instrument Society of America, ISA-76, International Conference and Exhibit, October 11-14, 1976.

While ferroresonant devices have found use in inverter applications and the like, their use as a line voltage regulator, per se, in conjunction with computer and other installations has not found favor. This principally is due to their statistically unreliable performance on unbalanced three phase loads; their tendency toward instability under certain three phase loading conditions; and their inability to provide high currents sometimes required in starting loads. Earlier designs also have tended to be unstable at light loads due to low input choke impedance. Three phase ferroresonant regulators have been observed to exhibit instability in developing a proper sinewave output. When instability results in a loss of a proper sinewave output for computer utilization, the computers necessarily are shut down. Where practical correction can be made available to overcome this deficiency, however, the devices hold promise of finding widespread use as a power conditioning system. If the single phase ferroresonant regulators could be made operable under all three phase loading conditions, if three phase ferroresonant regulators could be designed such that their outputs do not fall into non-sinewave patterns, the ferroresonant type regulators would exhibit a highly desirable voltage regulation technique. Unfortunately, however, the design of the ferroresonant regulators to avoid instability is one which is heueristic in nature and achieving a satisfactory result is an evasive endeavor.

A more recent aspect of the power requirements of computer facilities is concerned with the accommodation of high start-up surge currents in computer components. It is desirable that line power be regulated to provide a proper sinewave input to the computer facility as well as to provide over-voltage and under-voltage regulation. However, for the transient period of start-up, there is required a capability for delivering as much surge current as possible to the computer components. For example, a typical motor utilized in computer devices will draw three amps current under steady state condition while it may draw as much as 20 amps for a matter of seconds while it is starting up and developing proper speed. A traditional weakness of ferroresonant transformers has been that they are unable to supply such start-up surges. Further, inverter devices utilizing ferroresonant techniques are designed specifically not to pass high currents and to transfer to alternate power in the event of a call for surge currents.

SUMMARY

The present invention is addressed to voltage regulating apparatus particularly suited for use as a power conditioning system for computer installations which utilizes a ferroresonant synthesizing network and enjoys the advantages attendant therewith and which is immune from the unsatisfactory characteristics heretofore associated with such networks. The excellent stability and reliability of the system stem from the investigations and discoveries of the nature of these formerly encountered unsatisfactory phenomena.

Among such discoveries are those wherein distorted output waveshapes of the synthesizer networks have been found to contain significant second harmonics, a phenomena heretofore seldomly encountered. A third harmonic also is detected in certain of the distorted output waveshapes along with higher order harmonics in lesser amount. The distorted output waveshapes develop from an energy related improper association of components within the synthesizing networks which have been found to be generated in consequence of a form of shock occasioned from a variety of transient electrical occurrences. For example, such shocks may occur over a statistically unacceptable number of instances at start-up, during load dumping, during load shedding and other such occurrences. By incorporating series tuned trap circuits coupled with the synthesizer network at a location effecting the output waveshape to substantially reduce the tendency thereof to evolve harmonics above fundamental, a highly stable, properly configured sinewave output is assured.

The invention further enjoys the advantage of accommodating for initial start-up high current surges, permitting its utilization with modern computer facilities requiring such surge inputs. Through the selective design of non-linear input chokes, the system is capable of carrying a high current under overload conditions. In effect, the line power is tightly coupled to the load, the synthesizing network of the system essentially being overridden. Following such surge current performance, however, the system reverts to its proper waveshape synthesizing performance, in consequence of the utilization of the above-described series tuned trap arrangement.

As another feature and object of the invention, apparatus for use with an a.c. source of variable waveshape and given frequency for providing a regulated a.c. output to a load is provided which includes an input choke arrangement coupled with the a.c. source for deriving an energy input substantially immune from the variable waveshape phenomena and voltage level alterations. A synthesizer network is provided for generating a predetermined output waveshape, for example a sinewave, including polyphase pulse saturable reactors coupled across the the a.c. output. These reactors operate in conjunction with a capacitor arrangement coupled across the a.c. output for effecting the oscillatory saturation of the reactors at the given or line frequency. The synthesizer network is coupled within the system in series through the use of a primary winding arrangement coupled with the input chokes and magnetically associated with the reactors for transferring the input energy thereinto. Series tuned traps are coupled with the synthesizer network at a loaction affecting the predetermined output waveshape to substantially reduce the harmonics which might occur thereat as they exist above fundamental and below the eleventh harmonic and which occur in conjunction with transient phenomena otherwise causing a mode of operation of the synthesizer network not generating the predetermined or sinewave waveshape.

As another object of the invention, the input chokes are configured having a non-linear response characteristic for effecting a substantial impedance at levels of the load extending from low values to full load conditions and effecting a diminishing impedance to the a.c. source for overload conditions to effect a conveyance of transient load start-up surge currents, whereby the synthesizer network oscillatory saturation performance is effectively overridden during the conveyance of such surge currents. Preferably, the input chokes are formed incorporating a selectively gapped center leg.

Other objects of the invention will, in part, be obvious and will, in part, appear hereinafter.

The invention, accordingly, comprises the apparatus and system possessing the construction, combination of elements and arrangement of parts which are exemplified in the following detailed disclosure. For a fuller understanding of the nature and objects of the invention, reference should be had to the following detailed description taken in connection with the accompanying drawings.

BRIEF DESCRIPTION OF THE DRAWINGS

FIGS. 9A and 9B show waveshapes associated with load dumping phenomena, FIG. 9A showing such waveshapes representing the prior art and FIG. 9B showing a corresponding waveshape evolved by the instant invention;

FIG. 10 is a series of curves for an input choke configured in accordance with the invention; and FIG. 11 is a sectional view of an input choke having the characteristics shown in FIG. 10.

DETAILED DESCRIPTION

The regulating apparatus of the invention is particularly suited by virtue of its reliability and quality of regulation for use in conjunction with computer facilities. Generally, such facilities are centrally located within a building and, over the recent past, have been formed of components which are somewhat movable so as to afford a flexibility of computer system design. Accordingly, regulators fabricated in accordance with the invention preferably are structured so as to provide a modularity or mobility such that they may be maneuvered within the computer environment to supply regulated power for any of a variety of computer component configurations.

Figure 1:
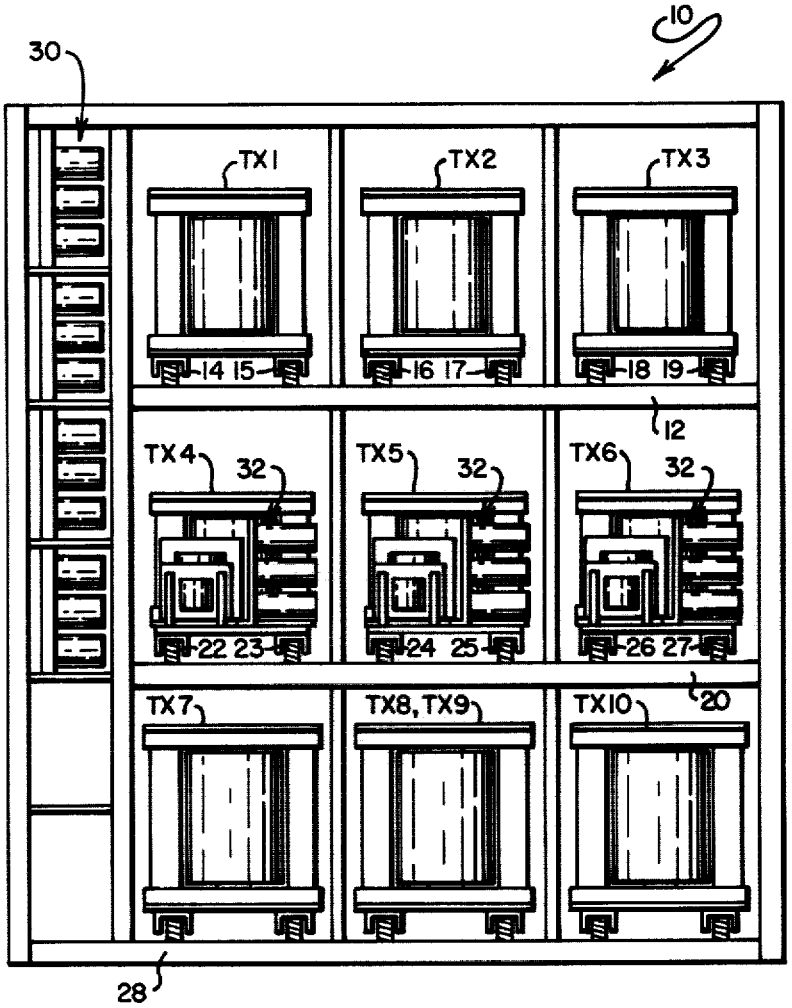
FIG. 1 is a pictorial representation of a console retaining apparatus according to the invention.

Looking to FIG. 1, a modular form of power regulator cabinet is represented generally at 10. The forward control panel of the power management assembly represented at 10 is removed such that the shelves upon which reactors and the like are positioned may be schematically portrayed. In the figure, it may be noted that a bank of three regulating transformers, TX1, TX2 and TX3 are shown mounted upon an upper shelf 12, such mounting, respectively, being provided through the use of spring mounted supports 14–19. Similarly, an intermediate shelf 20 supports saturable reactors TX4, TX5 and TX6 through spring mounted supports 22–27. The bottom shelf 28 of assembly 10 supports a combination of input chokes TX7, TX8 and TX9 as well as a neutral deriving or grounding transformer, not shown, TX10. Assembly 10 also includes a bank of delta connected capacitors represented generally at 30 and a series of traps at shelf 20 which include capacitors and reactors represented generally at 32.

Figure 2:
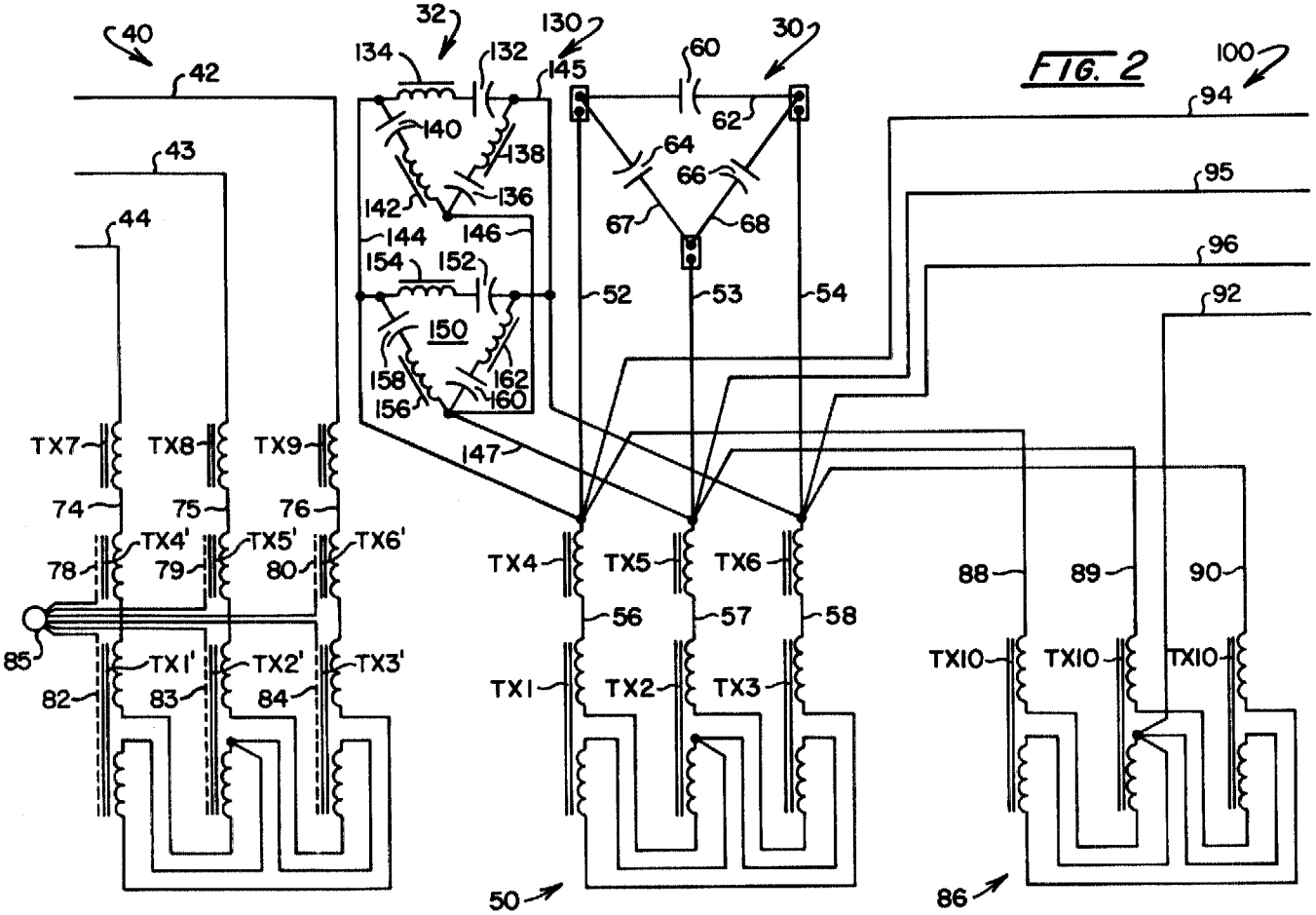
FIG. 2 is a schematic diagram of a circuit incorporating the features of the invention.

Now turning to FIG. 2, a schematic diagram showing all the components represented within the assembly 10 is shown. The drawing reveals an input side of the regulator apparatus at 40 having three input lines 42–44 which are connectible to a conventional utility derived power supply and which represent the line input to the regulating features. Lines 42–44 extend, in turn, to input chokes TX7, TX8 and TX9. These input chokes are configured by gapping techniques and the like to exhibit a variable impedance to line input. Input chokes TX7–TX9 perform as a buffer at the source of power represented by the line source 42–44 which has a unique sine waveshape and a unique voltage associated with it. The input chokes transfer the energy of that power source into a sine wave synthesizer represented generally at 50 without transferring thereinto the wave shape associated with incoming lines 42–44 or the voltage characteristics thereof. In other words, chokes TX7–TX9 act as a very spongy connection between the power line input and the synthesizer 50 so as to isolate these two sources from each other. Synthesizer 50 requires, from the line source, energy within a usable band of voltage and having a frequency reference (60 Hz), the synthesizer 50 following the frequency at the line power source.

Figure 2A:
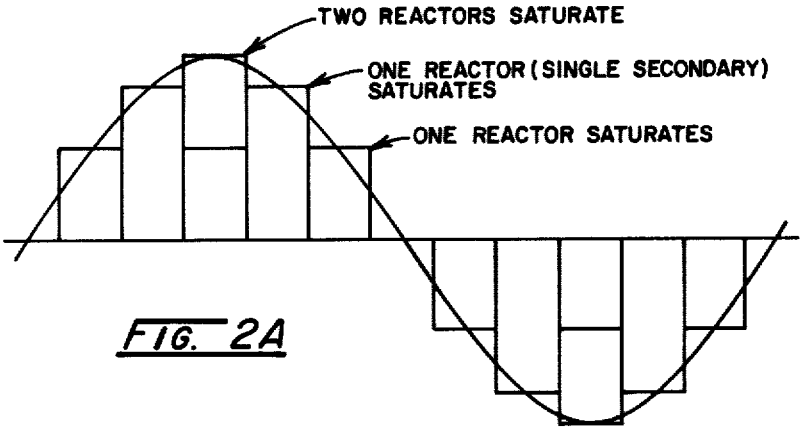
FIG. 2A is a sinewave showing the synthesis thereof by pulse positioning in accordance with the operation of the circuit of FIG. 2.

Now, examining the structure of the synthesizer network 50, it may be observed that it is comprised of six saturable reactors TX1–TX6 which operate in concert with a capacitor bank represented generally, as in FIG. 1, at 30. In an ideal sense, the saturating reactors have the ability to change their impedance very rapidly from an open circuit to a short circuit condition as saturation is carried out. These six reactors saturate in a sequence such that when one saturates, it drives another out of saturation. By observing that the saturation frequency rotates at line frequency, a unique pulse or pulses may be evolved from each reactor for every one-half cycle. The pulse height depends upon the characteristic of the reactor, i.e. the iron or copper in its core and consequent saturation density, while the width of these discrete pulses becomes a function of line frequency. Looking to FIG. 2A, the buildup of such pulses evolving a sine wave configuration is schematically portrayed. In actuality, these pulses which compose the sine waveshape are never seen at the load due to the filtering action of the capacitor bank 30. Of the reactors within network 50, note that saturable reactors TX4, TX5, and TX6, are coupled with respective lines 52–54 and are configured as saturating reactors with a single secondary or choke configuration. These reactors are coupled through respective lines 56–58 to reactors TX1, TX2 and TX3. The latter reactors are shown wired as transformers and are interconnected in zig-zag fashion, a technique conventionally used in forming grounding transformers as are used in utility functions to achieve a neutral output from three wires. Reactors TX1–TX3 additionally are shown to be coupled in series with reactors TX4–TX6.

Capacitor bank 30, incorporating a capacitor formation represented at 60 in line 62, capacitor formation 64 in line 67 and capacitor formation 66 in line 68 are connected in conventional delta configuration for connection with the saturable reactors. These capacitors serve as storage elements which maintain the lower six saturable reactors in oscillation. To achieve the sine wave form of FIG. 2A, the latter saturable reactors must saturate and ring with the capacitors within capacitor bank 30.

Energy is inserted into saturable reactors TX1–TX6 in magnetic fashion by corresponding primary windings TX1′–TX6′ connected in series with the outputs of input chokes TX7–TX9. The figure reveals that the output side of input choke TX7 is coupled through line 74 to primary winding TX4′ which is associated with reactor TX4 as well as primary winding TX1′ which is associated with reactor TX1. Similarly, the output of input choke TX8 is coupled through line 75 in series with the primary winding TX5′ associated with reactor TX5, as well as to primary winding TX2′ which is associated with reactor TX2. In like manner, the output of input choke TX9 is present at line 76 which is coupled in series with primary winding TX6′ which is operatively associated with reactor TX6 and with TX3′ which is operatively associated in primary winding fashion with reactor TX3. Windings TX1′–TX3′ are interconnected in the earlier described zig-zag configuration. Faraday shields 78–80 are shown associated with the cores of respective windings TX4′–TX6′, while similar Faraday shields 82–84 are shown associated with the cores of primary windings TX1′–TX3′. These Faraday shields are shown coupled to a conventional ground or neutral position represented by connection 85. The Faraday shields extend between primary and secondary windings and are connected to ground to lower interwinding capacitance and thus prevent the transfer of common mode line noise therebetween. It is important to note that, through the use of magnetic coupling of energy from the line input region 40 to the synthesizing components 50, a series coupling is evolved. Such a series coupling improves the performance of the overall device inasmuch as it prevents the passthrough of common mode noise. Further, the coupling technique is found helpful in stepping up or stepping down voltage and avoids dangerous voltage excursions in the event of catastrophic failure occasioned through broken wires or the like. Where such breakage occurs, the energy source is removed from the system to avoid damage.

Synthesizing network 50, when operationally combined with the input chokes TX7–TX9 and the capacitor bank 30, serves to generate a three phase waveshape, however, the combination does not serve to generate a neutral or reference output. Consequently, a grounding transformer represented at 86 having input lines 88–90 coupled with respective lines 52–54 of synthesizer network 50 is provided. Grounding transformer 86 is provided combining three coil structures identified at TX10 which combine with a single three phase core to generate a neutral wire represented at 92. Note, that the coils of transformer 86 are interconnected in the earlier described zig-zag fashion. Neutral output is provided at output terminal 92 which serves in conjunction with output terminals 94–96 of the synthesizing network 50 which are coupled, respectively, with lines 52–54.

Figure 3:
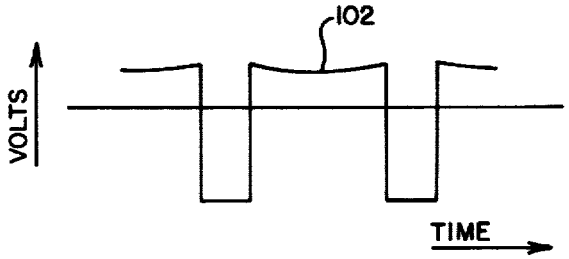
FIG. 3 is a representative perturbative waveshape.
Figure 4:
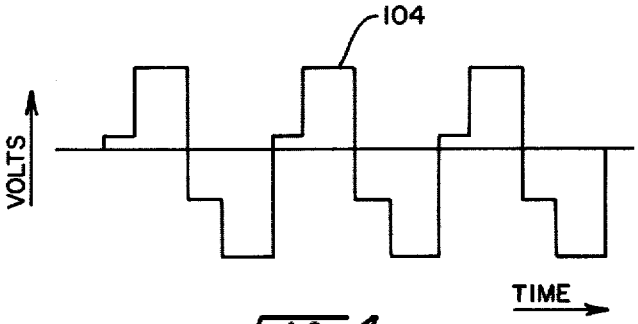
FIG. 4 is another representative perturbative waveshape.

When considered statically, the regulating system thus far described is one providing highly consistent sine wave output immune from the vagaries which may be developed at the line input 40. The sine wave formation developed exhibits only eleventh harmonic characteristics above and beyond the fundamental. This sinewave generating condition represents a conservation of energy, examination of the power characteristic of the system showing that it is absorbing the least energy when evolving a proper sinewave. The sinewave configuration and condition of least energy absorption has been observed to be one which essentially always is present as the system operates under heavy loads. However, without more, the technique of regulation is one which is statistically unreliable due, it has been discovered, to its susceptibility to "shocks" which may be occasioned from numerous conditions and which result in non-sinusoidal waveshapes which will persist unless corrected. Two such waveshapes are shown in FIGS. 3 and 4, that shown in FIG. 3 at 102 representing distortion of even harmonics, while that shown at 104 in FIG. 4 representing a combination of odd harmonics. These waveshapes represent an improper sequencing of the pulses evolved from the synthesizing network 50 as well as an operation of that network not at its lowest available energy utilization level. The triggering or shocking of synthesizer network 50 developing these aberrations has been discovered to emanate from any of a variety of transient causes. It may occur at turn on; through the application of a short circuit at some point following the release thereof; internal failures, for example arcing connections, as well as the turning on of a transformer at some position within the load, which transformer may retain a heavy magnetizing current. Whatever the cause triggering the unacceptable output, it occurs at a statistical level unacceptable without correction. Other types of devices utilizing ferroresonant networks for voltage regulation generally have provided them in connection with inverter systems or the like wherein, upon the first occurrence of an unacceptable waveshape, an auxiliary source is switched into the system to avoid the difficulty. No such auxiliary source is cost justifiable in the practical regulators contemplated for use in conjunction with the computer industry.

Figure 5:
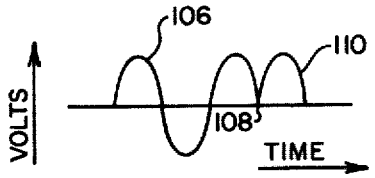
FIG. 5 is a waveshape associated with a load transformer at start-up.
Figure 6:
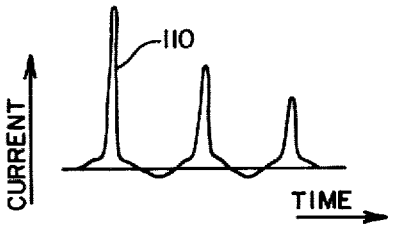
FIG. 6 is a current waveshape associated with the curve of FIG. 5.

Looking to the instance involving transformers positioned at some point within loads in developing a "shock" effect which unstabilizes synthesizer networks as at 50, it may be observed that when transformers are turned off following some period of energization, their cores generally will remain in some magnetic state. This condition may continue for a period of days. When turned on again, statistically from time to time their magnetic states will be in conflict with the cyclic condition of power imposed at turn on. Looking to FIG. 5, a typical a.c. wave is shown at 106 as introduced to a load transformer. If the transformer is turned off, for example at a time represented at 108, a positive half cycle of magnetization will remain in its core. Upon a next energization of the load transformer, should power be applied commencing with the beginning of a positive half cycle, the transformer will see double the volt seconds which it was designed to accommodate as represented by half cycle 110. The net result is the imposition of a d.c. current to the transformer which causes it to draw an extremely high current because of the low impedance of a transformer to d.c current. Looking additionally to FIG. 6, when the load transformer turns on, a natural waveshape of magnetizing current looks similar to that shape depicted at 110. This shape represents a truncated series of peaks and shows that there is saturation present on the a.c. line. This will continue until an a.c. balance is regained within the core of the load transformer. The initial peaks shown at waveshape 110 are relatively large, ranging from 300–400 amps. The result with respect to regulation of the input to the load is one wherein a d.c. level is drawn from the synthesizing source. This represents a shock which can evolve aberrational output waveshapes as described earlier in connection with FIG. 3 and FIG. 4 on a statistical basis which is unacceptable. Generally, any load device will draw some form of d.c. surge at start up, depending upon the state of its inductive elements at turn off.

Figure 7A:
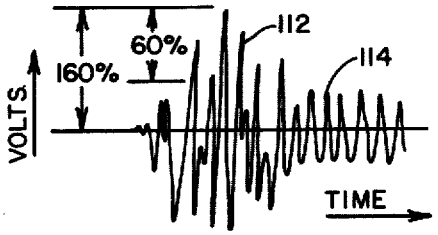
FIGS. 7A and 7B are representative waveshapes showing the output of regulative apparatus according to the prior art (FIG. 7A) and with the instant invention (FIG. 7B)

For any given turn on of the system and associated load, there will be a very short interval wherein the output will evidence an improper waveshape. However, generally, as 30%–40% load is added, the system will revert to its proper energy level and a sinusoidal waveshape will be achieved without the continued generation of a perturbational, unacceptabble waveshape output. However, the interval during which this "hunting" effect occurs readily may extend to a period representing a shock condition from which the system cannot recover. Looking to FIG. 7A, a typical output voltage representation of the synthesizing network 50 is shown at a point of turn on. Note, that the voltage peaks or excursions extend to about 160% of the normal operational envelope during start up without correction. This condition can represent a shock situation as above discussed. The initial hunting interval is represented in FIG. 7A at 112, while a normal voltage output for the synthesizing network is represented adjacent thereto at 114.

Figure 8A:
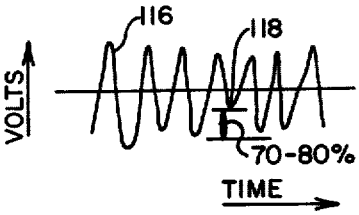
FIGS. 8A and 8B show representative outputs of regulative apparatus according to the invention during a load pickup condition, FIG. 8A showing a typical waveshape of the prior art and FIG. 8B showing a waveshape evolved with the instant invention.

Another condition which may arise leading to a "shock" phenomena occurs upon the picking up of a load. Looking to FIG. 8A, the normal output of the synthesizer network is represented at waveform 116. At the point in time when a load is picked up, as represented at curve portion 118, an excursion representing 70%-80% of normal waveshape envelope may be witnessed. This has been discovered to be a sufficient phenomena to evolve a shock condition leading to a continuous aberration of the output waveshape of synthesizer network 50.

Still another transient condition which may be encountered, typically in the operation of computer systems is that of dumping a load. Looking to FIG. 9A, a conventional output waveshape is represented at curve portion 120, while the transient phenomena associated with load dumping is represented by excursion portion 122 of the waveform. This excursion may represent a 60% excursion of the normal peak envelope. The occurrence of this transient phenomenon will cause the synthesizing network 50 to temporarily lapse into a non-sinusoidal wave output.

Returning to FIG. 2, the correction to the system and apparatus which ameliorates the above-noted transient phenomena such that a "shock" condition causing the ferroresonant system to lose its proper sequencing capability is effectively avoided is represented by the network of traps shown generally at 32. These traps include six reactors and associated capacitors configured in the form of tuned circuits that are connected across the output of synthesizer network 50. One combination of three of these series tuned traps is represented generally at 130 as including a first series resonant circuit formed of capacitor 132 and reactor 134. A second series resonant circuit of combination 130 is represented by capacitor 136 and reactor 138, while a third series resonant circuit or trap is represented by capacitor 140 and reactor 142. Trap combination 130 is connected in delta configuration and the capacitive and reactive components of each circuit therein are selected to resonate at the third harmonic. Connection of the delta configuration 130 across the output of the system is by lines 144 and 145 coupled, respectively, to lines 52 and 54, and by lines 146 and 147, the latter being coupled to line 53.

A second trap combination is represented generally at 150 and includes an initial series resonant circuit including capacitor 152 and reactor 154. A second series resonant circuit is shown comprising reactor 156 in operational combination with capacitor 158, while a third series resonant circuit within the combination is represented by capacitor 160 operating in association with reactor 162. Note, that the series tuned traps of combination 150 also are coupled in delta configuration and that the components thereof are selected so as to be tuned to the second harmonic. Connection of trap combination 150 with lines 52 and 54 is through respective lines 144 and 145, while connection thereof to line 53 is from line 147.

In their operation, trap combinations 130 and 150 will remain passive within the system, an ideal sinewave output being generated by network 50 which is immune from line input variations of considerable magnitude. However, upon the occurrence of the above described "shock" type transient phenomena, the trap combinations 130 and 150 wil short out the harmonic energy thereof, such energy having been discovered to be a principal component of the transient phenomena. In this regard, it has been discovered over an extended series of observations that the aberrational output waveforms of network 50 always will include significant second and/or third harmonic components. This phenomenon obtains for every one of the non-sinewave modes which the system can revert to.

FIG. 3 represents a condition wherein only even harmonics are involved, including the second harmonic. With respect to this second harmonic, investigators have considered the presence thereof to be highly unusual, representing an unsymmetrical waveform not usually generated with conventional devices. FIG. 4 shows an output waveshape aberration incorporating only odd harmonics. By shorting these harmonics out at the output of the system or at any appropriate other position, with a tuned series trap, the capability exists for preventing the unacceptable operational modes as are represented at FIGS. 3 and 4 as well as other modes from taking place. As a consequence, the regulating apparatus achieves a reliability rendering it amenable to use in conjunction with modern computer facilities. The advantages of such use are numerous, the number of components required for the system being significantly lower than those required in other systems. Small amounts of other harmonics also have been seen to be present, however, the arrangement shown eliminating third and second harmonic energy has been found to be fully acceptable in rendering the system reliable.

The trap combinations as at 130 and 150 serve to force the energy representing unwanted harmonics back to the fundamental as a form of energy reflection. Those skilled in the art will recognize that the positioning of the series tuned trap with the synthesizer network 50 should be at a location affecting the output waveshape. Consequently, the traps can be positioned at any location wherein the output waveshape is witnessed, i.e. any position where they can affect the synthesized or created waveshape, for example the position functionally within the circuit beyond the output of input chokes TX7-TX9. As is apparent, other trap configurations may be provided other than the preferred arrangement shown at 32. For example the function may be carried out utilizing a single resonant trap circuit tuned for operation at an intermediate point between the second and third harmonic. Other trap combination couplings also may be utilized, for example open delta, wye or simple single phase line-to-line.

Figure 7B:
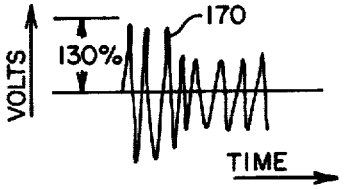
Figure 8B:
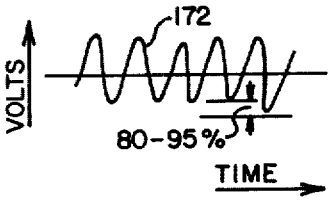

Looking to FIG. 7B, the result of utilizing a trap network as at 32 is shown in connection with a typical waveshape 170 encountered during turn-on phenomena. Note, that the excursion at turn-on, of the peaks is limited to about 30% of the normal operational waveshape envelope as opposed to the 60% valuation described in connection with FIG. 7A. Similarly, looking to FIG. 8B, the effect upon waveshape 172 upon the occurrence of a load pickup phenomenon is represented. Note that the voltage excursion is limited to 80%-95% of the normal operational peak envelope thereof. Further, looking to FIG. 9B, waveshape 174 shows the effect to trap network 32 during load dumping. As is shown by the waveshape 174, the voltage excursion during load dumping is limited to about 30% of the normal waveshape envelope. All of these corrections have been found sufficient to eliminate the "shock" effect to the extent that aberrational output waveshapes are effectively eliminated.

As indicated earlier herein, the more recent designs of computer facilities have called for equipment necessarily requiring significant surge currents at startup. Normally, regulator systems are not designed to accommodate for such surge current requirements, inverter systems typically switching to stand-by power implements upon the initial detection of a surge current. As another aspect of the instant invention, a capability is provided for supplying those surge currents to the load by closely coupling the line input power source with the load during that transient interval requiring a surge-categorized input. To carry this out, the input chokes TX7-TX9 are configured having a highly non-linear characteristic. This characteristic is arranged such that for conditions extending from relatively light or low loads through full design load, a relatively high impedance is effected. Generally, this is carried out by selective gapping techniques. However, for heavy overload conditions beyond full load situations, the input chokes are designed so as to lower the impedance exhibited thereby and permit the conveyance of surge current from the source to the load. In effect, a very close coupling of the input chokes with the load is achieved by the selective non-linearity of the former. During surge conditions, the conventional sinewave output of synthesis network 50 becomes passive to permit surge condition coupling. Under these conditions, high currents are evolved and the output voltage of the system drops. As that voltage falls 10% below rated output voltage, the ferroresonance achieved at network 50 essentially is stopped. Ultimately, the voltage available is lower than the voltage at which network 50 operates in a ferroresonant attitude. As the surge requirement drops to normal full load, the system carries on in a normal sinewave synthesizing mode as is required for normal computer facility performance. Because of the performance of resonant trap network 32, however, the transient "shock" effect which otherwise would drive the synthesizing components to produce an unacceptable waveform are avoided through short circuiting of the earlier-discussed harmonics.

Looking to FIG. 10, a series of characteristic curves for input chokes suited for the instant purpose are revealed at 180, 182, and 184. The curves in the figure plot impedance in ohms, as exhibited by the input chokes, with respect to voltage across the chokes, which voltage is directly related to load value. The curves 180, 182 and 184 are derived from triple gap core input chokes. Typically, a full load condition will be represented by a voltage of about 140 volts. Looking to the impedance range for each of the curves within that voltage related load valuation, it may be seen that the impedance characteristic, while diminishing, remains relatively high for loads ranging from minimal to full load. However, for overload conditions, the chokes exhibit an impedance characteristic wherein the impedance exhibited thereby diminishes significantly. This permits the surge coupling capability of the apparatus of the invention as described hereinabove. Techniques for providing single or multi-gap cores for chokes are well known in the art.

Looking to FIG. 11, a sectional view of an input choke having the characteristics shown at curves 180, 182 and 184 is revealed generally at 190. Choke 190 is configured in generally conventional form, having a laminar outer shell 192 formed of a plurality of rectangularly shaped magnetic steel plates. These plates of shell 192 define an inwardly disposed cavity within which is positioned a tri-gapped center leg 194. Leg 194 also is formed in laminar form of a plurality of magnetic steel sheets and is surrounded by a winding represented at 196. Center leg 194 is configured at its extremities so as to define three oppositely disposed gap configurations identified at G1, G2 and G3. Thus, at lighter loads, the flux path is generally associated with gap G1 and, as heavier loads are imposed, gap G2 becomes effective as a flux path. Finally, at loads beyond full load, gap G3 becomes effective as a flux path and the impedance of the entire input choke 190 drops as revealed in connection with FIG. 10.

Since certain changes may be made in the above-described system and apparatus without departing from the scope of the invention herein involved, it is intended that all matter contained in the description thereof or shown in the accompanying drawings shall be interpreted as illustrative and not in a limiting sense.

I claim:

1. Apparatus for use with an a.c. source of variable voltage level and waveshape, and having a given frequency for providing a regulated a.c. output to a load having a variable current demand comprising:

input choke means coupled with said a.c. source for deriving an energy input substantially immune from said variable waveshape and voltage level, said input choke means having a varying gap core for deriving a non-linear impedance characteristic corresponding with said load variable current demand wherein substantially high impedance is exhibited in the presence of low said load demands and lower impedance is exhibited in the presence of higher said load demands;

synthesizer network means for normally generating a predetermined output waveshape, providing that externally generated transient phenomena are not imposed thereupon, including polyphase pulse saturable reactor means coupled across said a.c. output, capacitor means coupled across said a.c. output for effecting the oscillatory saturation of said reactor means at said given frequency, and primary winding means coupled with said input choke means and magnetically associated with said reactor means for transferring said input energy thereto;

first series tuned trap means coupled with said synthesizer network means at a location affecting the said predetermined output waveshape and configured to return any second harmonic of said output waveshape generated by said transient phenomena to fundamental; and second series tuned trap means coupled with said synthesizer network means at a location affecting the said predetermined output waveshape configured to return any third harmonic energy of said output waveshape generated by said transient phenomena to fundamental.

2. The apparatus of claim 1 in which:

said first trap means includes a first series tuned capacitor and reactor network configured to return any second harmonic of said output waveshape to said fundamental; and said second trap means includes a second series tuned capacitor and reactor network configured to return any third harmonic energy of said output waveshape to said fundamental.

3. The apparatus of claim 1 in which said choke core includes a center leg having a first gap configured to derive first impedance value at low load current, a second gap configured to derive a second impedance value at full load current and a third gap configured to derive a third impedance value at load currents of value above said full load current.

4. The apparatus of claim 3 in which said third impedance value is less than said second impedance value and said second impedance value is less than said first impedance value.

5. The apparatus of claim 4 in which said third gap is configured having a large volumetric extent than said second gap and said second gap is configured having a larger volumetric extent than said first gap.

6. The apparatus of claim 1 in which said first gap means comprises three series tuned capacitor and reactor circuits interconnected in a delta configuration and tuned to return any third harmonic energy of said output waveshape to said fundamental.

7. The apparatus of claim 1 in which said second trap means comprises three, series tuned capacitor and reactor circuits interconnected in a delta configuration and tuned to return any second harmonic energy of said output waveshape to said fundamental.

8. The apparatus of claim 1 in which:

said first trap means comprises three series tuned capacitor and reactor circuits interconnected in a delta configuration and tuned to return any third harmonic energy of said output waveshape to sid fundamental; and said second trap means comprises three series tuned capacitor and reactor circuits interconnected in a delta configuration and tuned to return any second harmonic energy of said output waveshape to said fundamental.

9. The apparatus of claim 8 in which said synthesizer network means pulse saturable reactor means comprises:

three transformer configured pulse saturating reactors interconnected in zig-zag coupling; and three pulse saturating reactors in single secondary configuration coupled in series with said transformer configured reactors.

10. The apparatus of claim 9 in which said synthesizer network capacitor means comprises delta coupled capacitors connected in series with said three pulse saturating reactors.

11. The apparatus of claim 1 in which said synthesizer network means pulse saturable reactor means comprises:

three transformer configured pulse saturating reactors interconnected in zig-zag coupling; and three pulse saturating reactors in single secondary configuration coupled in series with said transformer configured reactors.

12. The apparatus of claim 11 in which said synthesizer network capacitor means comprises delta coupled capacitors connected in series with said three pulse saturating reactors.

13. The apparatus of claim 1 wherein said input choke means is configured having a non-linear response characteristic for effecting a substantial impedance at low levels of said load and effecting a low impedance to said a.c. source selected for overload conditions to effect the conveyance of transient load start-up surge currents, wherein said synthesizer network means oscillatory saturation performance is passive during said conveyance of surge currents.

14. The apparatus of claim 13 wherein said input choke means effects said selected low impedance to said a.c. source when the voltage of said output falls about 10% below the rated output voltage of said apparatus.

15. The apparatus of claim 1 including a grounding transformer, the primary windings of which are coupled across said a.c. output and which are associated with secondary windings thereof in zig-zag configuration for deriving a neutral output connectable with said load.

16. Apparatus for use with an a.c. source of variable voltage level and waveshape, and having a given frequency for providing a regulated a.c. output to a load having a variable current demand, comprising:

input choke means coupled with said a.c. source for deriving an energy input substantially immune from said variable waveshape and voltage level, said input choke means having a varying gap core for deriving a non-linear impedance characteristic corresponding with said load variable current demand wherein substantially high impedance is exhibited in the presence of low said load demands and lower impedance is exhibited in the presence of higher said load demands;

synthesizer network means for normally generating a predetermined output waveshape, providing that externally generated transient phenomena are not imposed thereupon, including polyphase pulse saturable reactor means coupled across said a.c. output, capacitor means coupled across said a.c. output for effecting the oscillatory saturation of said reactor means at said given frequency, and primary winding means coupled with said input choke means and magnetically associated with said reactor means for transferring said input energy thereto; and trap means including a frequency selective trap tuned to resonate at a selected value intermediate second and third harmonic energy levels and coupled with said synthesizer network means at a location affecting the said predetermined output waveshape for returning transient phenomena induced second and third harmonics to fundamental.

17. The apparatus of claim 16 wherein said input choke means is configured having a varying gap core for deriving an impedance characteristic corresponding with said load demands wherein substantially high impedance is exhibited in the presence of low said load demands, said impedance diminishing in correspondence with higher load demands to an extent wherein said impedance is selected for effecting conveyance of said start-up currents effecting a voltage drop at said reactor means of an extent wherein said oscillatory saturation is passive.

18. Apparatus for use with an a.c. source of variable voltage level and waveshape, and having a given frequency for providing a regulated a.c. output to a load having a variable current demand, comprising:

input choke means coupled with said a.c. source for deriving an energy input substantially immune from said variable waveshape and voltage level, said input choke means having a varying gap core for deriving a non-linear impedance characteristic corresponding with said load variable current demand wherein substantially high impedance is exhibited in the presence of low said load demands and lower impedance is exhibited in the presence of higher said load demands;

synthesizer network means for normally generating a predetermined output waveshape, providing that externally generated transient phenomena are not imposed thereupon, including polyphase pulse saturable reactor means coupled across said a.c. output, capacitor means coupled across said a.c. output for effecting the oscillatory saturation of said reactor means at said given frequency, and primary winding means coupled with said input choke means and magnetically associated with said reactor means for transferring said input energy thereto;

first frequency selective trap means coupled with said synthesizer network means at a location affecting the said predetermined output waveshape and configured to return a certain even harmonic of said output waveshape generated by said transient phenomena to fundamental; and second frequency selective trap means coupled with said synthesizer network means at a location affecting the said predetermined output waveshape configured to return a certain odd harmonic energy of said output waveshape generated by said transient phenomena to fundamental.

19. The apparatus of claim 18 wherein said input choke means varying gap core includes a center leg having a first gap configured to derive first impedance values at low load current, a second gap configured to derive a second impedance value at full load current and a third gap configured to derive a third impedance value at load currents of value above said full load current.

20. The apparatus of claim 14 in which said third impedance value is less than said second impedance value and said second impedance value is less than said first impedance value.

21. The apparatus of claim 20 in which said third gap is configured having a larger volumetric extent than said second gap and said second gap is configured having a larger volumetric extent than said first gap.

22. Apparatus for use with an a.c. source of variable voltage level and waveshape, and having a given frequency for providing a regulated a.c. output to a load having a variable current demand, comprising:

input choke means coupled with said a.c. source for deriving an energy input substantially immune from said variable waveshape and voltage level, said input choke means having a varying gap core for deriving a non-linear impedance characteristic corresponding with said load variable current demand wherein substantially high impedance is exhibited in the presence of low said load demands and lower impedance is exhibited in the presence of higher said load demands;

synthesizer network means for normally generating a predetermined output waveshape, providing that externally generated transient phenomena are not imposed thereupon, including polyphase pulse saturable reactor means coupled across said a.c. output, capacitor means coupled across said a.c. output for effecting the oscillatory saturation of said reactor means at said given frequency, and primary winding means coupled with said input choke means and magnetically associated with said reactor means for transferring said input energy thereto; and means coupled with said synthesizer network at a location affecting the said predetermined waveshape for forcing energy representing at least odd and even harmonics substantially near the second and third harmonics generated by said transient phenomena to fundamental as a form of energy reflection.

23. The apparatus of claim 22 wherein said input choke means is configured having a varying gap core for deriving an impedance characteristic corresponding with said load demands wherein substantially high impedance is exhibited in the presence of low said load demands, said impedance diminishing in correspondence with higher load demands to an extent wherein said impedance is selected for effecting conveyance of said start-up currents effecting a voltage drop at said reactor means of an extent wherein said oscillatory saturation is passive.

* * * * *